US006850722B2

(12) United States Patent
Sakemi et al.

(10) Patent No.: US 6,850,722 B2
(45) Date of Patent: Feb. 1, 2005

(54) IMAGE FORMING APPARATUS

(75) Inventors: Yuji Sakemi, Toride (JP); Koji Masuda, Moriya (JP); Keiko Igarashi, Toride (JP); Tomoyuki Sakamaki, Toride (JP); Kota Arimoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/265,790

(22) Filed: Oct. 8, 2002

(65) Prior Publication Data

US 2003/0072588 A1 Apr. 17, 2003

(30) Foreign Application Priority Data

Oct. 9, 2001 (JP) ..... 2001/311733

(51) Int. Cl.[7] ..... G03G 15/01
(52) U.S. Cl. ..... 399/223; 399/227
(58) Field of Search ..... 399/120, 223, 399/224, 227, 257, 259

(56) References Cited

U.S. PATENT DOCUMENTS

| | | | | |
|---|---|---|---|---|
| 5,177,536 A | | 1/1993 | Watanabe et al. | 355/251 |
| 5,525,752 A | | 6/1996 | Izumizaki et al. | 118/658 |
| 5,669,050 A | | 9/1997 | Sakemi et al. | 399/270 |
| 5,752,141 A | | 5/1998 | Nishimura et al. | 399/227 |
| 5,797,069 A | * | 8/1998 | Kimura et al. | 399/223 |
| 6,047,149 A | | 4/2000 | Nishimura et al. | 399/98 |
| 6,067,433 A | | 5/2000 | Kimura et al. | 399/274 |
| 6,421,520 B2 | | 7/2002 | Masuda et al. | 399/277 |
| 6,442,355 B2 | | 8/2002 | Hasegawa et al. | 399/58 |
| 6,449,441 B2 | | 9/2002 | Masuda | 399/58 |

FOREIGN PATENT DOCUMENTS

| | | |
|---|---|---|
| JP | 7-152218 | 6/1995 |
| JP | 9-218575 | 8/1997 |

* cited by examiner

*Primary Examiner*—Fred Braun
(74) *Attorney, Agent, or Firm*—Fitzpatrick, Cella, Harper & Scinto

(57) ABSTRACT

An image forming apparatus includes an image bearing member; a plurality of first developing devices for developing an electrostatic latent image formed on the image bearing member at a developing position using a developer which includes a toner and a carrier; a rotatable member rotatable in a path including the first developing position, for supporting the plurality of first developing devices, wherein each of the plurality of first developing devices is effective to discharge excess developer produced by receiving the developer including the toner and the carrier to outside of each of the plurality of first developer devices using a rotation of the rotatable member; and a second developer container for developing an electrostatic latent image formed on the image bearing member at a second developing position using a developer including a toner, wherein the second developing device is disposed at a position so as to be non-rotatably adjacent to the image bearing member.

9 Claims, 4 Drawing Sheets

IMAGE FORMING APPARATUS

FIELD OF THE INVENTION AND RELATED ART

The present invention relates to an image forming apparatus employing an electrophotographic or electrostatic recording method. In particular, it relates to an image forming apparatus such as a copying machine, a printer, a facsimile machine, etc.

In the field of an electrophotographic image forming apparatus, in particular, a color image forming apparatus in accordance with the prior art, the two-component developing method, that is, a developing method which uses the two-component developer is widely used. The two-component developer is a mixture of nonmagnetic toner and magnetic carrier. In terms of image stability, apparatus durability, and the like, the two-component developing method is superior to other developing methods being currently proposed. However, it has its own problems. That is, it is unavoidable that the two-component developer, in particular, the carrier thereof, deteriorates with the elapse of time.

Therefore, when an image forming apparatus employing the two-component developing method is used for a long period time, the developer must be replaced after the elapse of a certain length of time.

There have been proposed several solutions to the problem. For example, according to one of the aspects of Japanese patent Application publication 2-215891, in order to form images stable in image quality by keeping constant the characteristics of the developer in the housing of the developing apparatus of an electrophotographic copying machine comprising: a stirring means for stirring the carrier and toner, and a development roller for supplying the stirred developer to the photoconductive member, the developing apparatus is provided with: the combination of a carrier supplying apparatus and a toner supplying apparatus, which are discrete or integral, and are disposed above the stirring means; and an surplus developer outlet, which is in one of the lateral walls of the developing apparatus housing, and fresh developer is gradually supplied to the developing apparatus from the combination of the carrier supplying apparatus and toner supplying apparatus, while the surplus developer is discharged from the surplus developer outlet configuration.

Also according to this publication, the aged developer within the developing apparatus housing is automatically and gradually discharged through the surplus developer outlet. Therefore, there is no need for the annoying developer replacement process which involves the removal of the developing apparatus from the copying apparatus, removal of the aged developer in the housing of the developing apparatus, replenishment of the housing with fresh developer, and re-attachment of the developing apparatus, and which is necessary when operating an Image forming apparatus in accordance with the prior art. Also according to, this publication, the developer is not going to be scattered into the ambience from the developing apparatus; the developing apparatus is hygienic.

In other words, according to the method disclosed in this publication, the deteriorated developer (carrier) is gradually replaced by the fresh developer, stopping thereby apparent deterioration of the carrier. Therefore, the characteristics of the developer as such stabilizes, eliminating the need for the developer replacement operation; improving the developing apparatus from the standpoint of maintenance.

Further, a proposal regarding a combination of this method and a rotary type developing apparatus is disclosed in Japanese Laid-open patent Application Hei 9-218575 (U.S.A patent Journal No. 5,752,141).

According to this proposal, the rotary type developing apparatus is provided with a developer supplying means in order to supply the developing apparatus with developer as necessary. As for the surplus developer in the developing apparatus, it is discharged from the developing apparatus utilizing gravity, that is, by utilizing the movement the rotary peculiar to the rotary in order to switch the side, from which gravity acts on the body of the developer in the developing apparatus. In other words, the surplus developer is discharged with the employment of a simple structure.

In comparison, Japanese Laid-open patent Application Hei 7-152218 (U.S. Pat. No. 6,047,149) discloses a structural arrangement for an image forming apparatus, which is based on the fact that the black toner consumption is greater than any of the yellow, cyan, and magenta toner consumption. According to this structural arrangement, the yellow, cyan, and magenta developing device are mounted in the rotary of the developing apparatus, whereas the black-developing devices is made larger than the color developing devices, and is virtually stationarily disposed in the adjacencies of the photoconductive member.

In recent years, the market for a full-color copying machine and a full-color printer has expanded. With the expansion of the market, the demand for multifunctional image forming apparatuses in particular, full-color image forming apparatuses capable of functioning as a black-and-white image forming apparatus, has increased. Thus, presently, there are strong desires from users for a full-color image forming apparatus which is simple in structure, excellent from the standpoint or maintenance, and yet, high in productivity when consecutively forming a substantial number of black-and-white images.

The proposed apparatus in Japanese Laid-open patent Application Hei 9-218575 was somewhat satisfactory in that it simplifies the structure for a developing apparatus. However, it was unsatisfactory from the standpoint of following concerns. The developing apparatus in accordance with the proposal failed to maintain its productivity at a high level during the consecutive formation of a large number of black-and-white images. On the other hand, when a full-color image is formed, the rotary of the developing apparatus is rotated each time a latent image is developed. Therefore, when a substantial number of full-color images are consecutively formed, the surplus developer in the developing apparatus is gradually discharged as the rotary of the developing apparatus is rotated. However, when a black-and-white image is formed, the rotary of the developing apparatus does not need to be rotated each time a latent image is developed: in other words, the black developing apparatus remains stationary. Thus, when a substantial number of black-and-white images are consecutively formed, the surplus developer is not discharged, although the developer is supplied to the black developing apparatus. Further, as described above, in order to consecutively form a substantial number of black-and-white images of high quality, the developer in the black developing apparatus must be gradually discharged so that it can be replaced with fresh developer. Therefore, even if an arrangement is made so that the amount by which the developer is discharged is adjusted according to the amount of the developer consumption, the rotary must be rotated once every several copies in order to recover the developer.

This operation is mandatory when developer is supplied by a larger amount due to the higher image ratio. Therefore, it has been impossible to avoid this problem that when forming a large number of black-and-white image using a full-color image forming apparatus, the productivity of the apparatus is reduced due to the rotation of the rotary of the developing apparatus mandatory for keeping the image quality at a satisfactory level. In other words, in terms of maintenance, a full-color image forming apparatus, in accordance with the prior art, employing a rotary type developing apparatus has been improved by structuring the apparatus so that the developers are automatically and gradually replaced. However, in terms of the productivity loss which occurs during the consecutive formation of a large number of black-and-white images, it has not been satisfactorily improved.

As for Japanese Laid-open patent Application Hei 7-152218, it discloses a developing apparatus which does not have the above described problem, and also, does not address the object of improving an image forming apparatus in structure in terms of maintenance.

Therefore, it could not answer the above described desires from users.

SUMMARY OF THE INVENTION

The primary object of the present invention is to provide an Image forming apparatus, the first developing apparatus of which is simple in structure, and yet, superior in terms of maintenance to a is conventional first developing apparatus, and the productivity of which does not reduce when forming a large number of images using the second developing apparatus.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the image forming apparatus in accordance with the present invention will be described in more detail with reference to the appended drawings.

Embodiment 1

Figure 1:
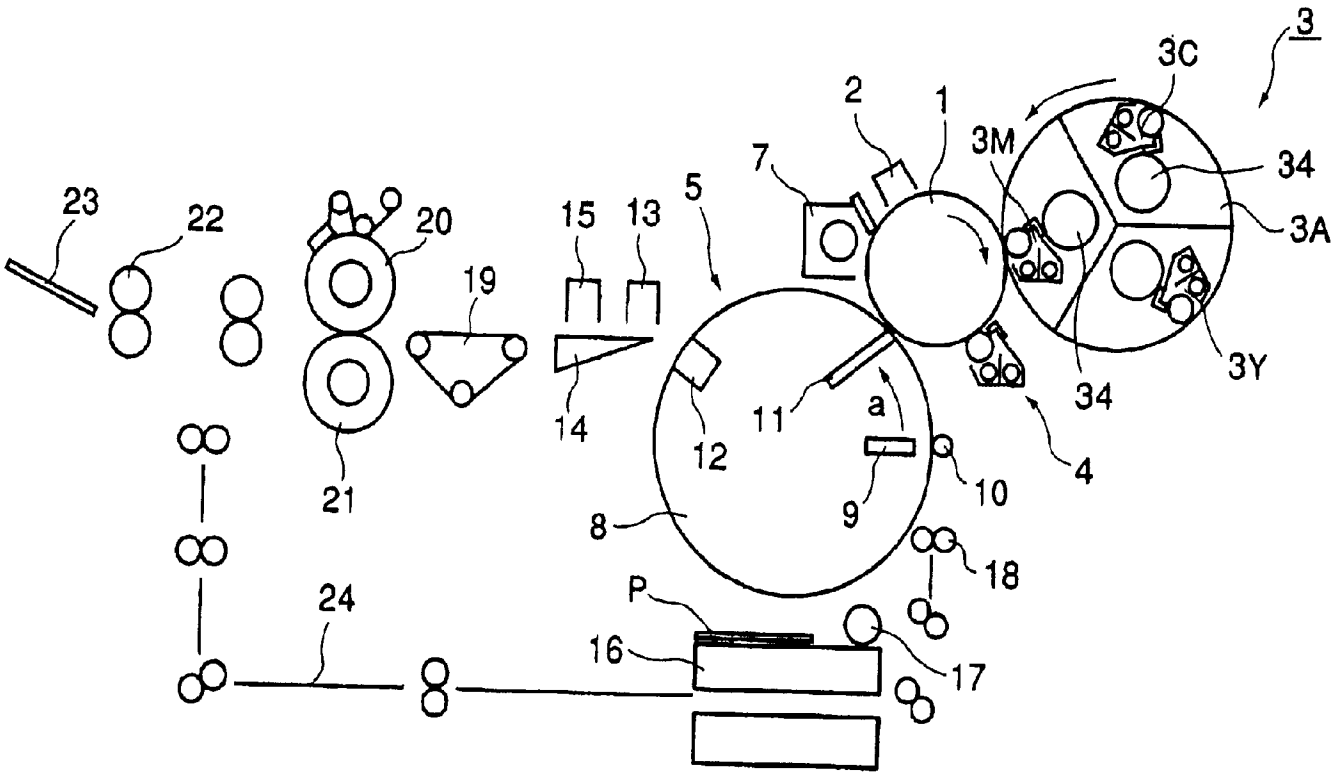
FIG. 1 is a schematic drawing of an example of an image forming apparatus in accordance with the present invention.
Figure 2:
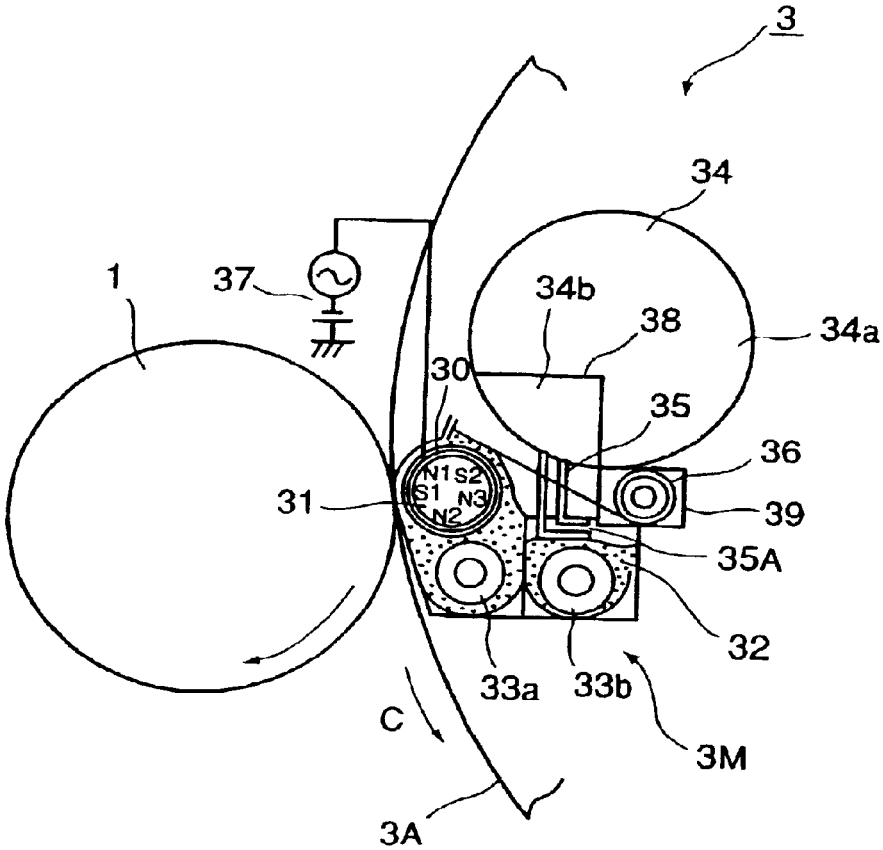
FIG. 2 is a sectional view of the color developing apparatus disposed in the image forming apparatus in FIG. 1.
Figure 3:
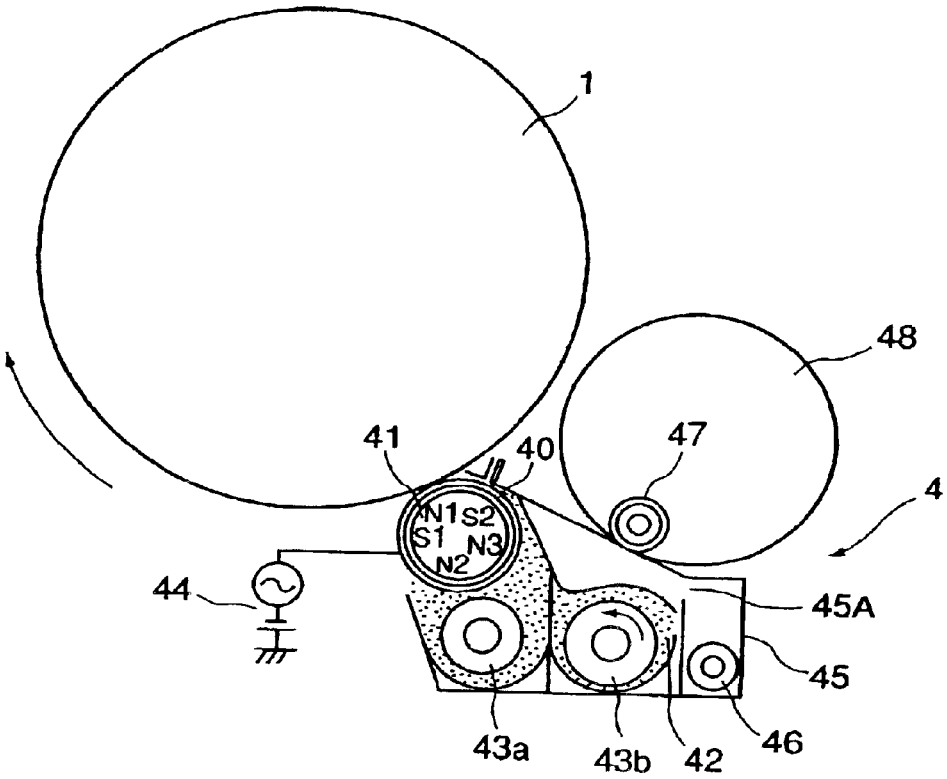
FIG. 3 is a sectional view of the black developing apparatus disposed in the image forming apparatus in FIG. 1.

FIG. 1 is a schematic drawing of an example of an image forming apparatus in accordance with the present invention. FIG. 2 is a sectional view of one of the color developing apparatuses employed by the image forming apparatus in FIG. 1. FIG. 3 is a sectional view of the black developing apparatus employed by the image forming apparatus in FIG. 1—This image forming apparatus is structured as a color copying machine.

In the main assembly of the image forming apparatus in this embodiment, a photoconductive drum (electrophotographic photoconductive member in form of drum) 1, as an image forming member, is supported by an axle so that it can be rotated in the direction indicated by an arrow mark. Disposed around the photoconductive drum 1 are image forming means, such as a primary charging device 2, a developing apparatus 3, a developing apparatus 4, etc.

The photoconductive drum 1 is uniformly charged, across its peripheral surface, by the primary charging device 2. Onto the uniformly charged peripheral surface of the photoconductive drum 1, an optical image of an original, which corresponds to one of the primary colors of the original, or an optical image equivalent thereto, is projected by an unshown exposing means, such as a laser beam exposing apparatus, etc. As a result, an electrostatic latent image is formed on the peripheral surface of the photoconductive drum 1. To this electrostatic latent image, developer (toner) is adhered by the developing apparatus 3 or developing apparatus 4. As a result, a toner image, that is, a visible image, is formed.

The color developing apparatus 3 is a rotary type developing apparatus comprising two-component type developing apparatuses 3m, 3C, and 3Y, which contain magenta color toner, cyan color toner, and yellow color toner, respectively, and carrier as well. The developing apparatuses 3 (3M–3Y) are mounted in a rotary (development rotary) 3A, so that in order to develop the electrostatic latent image on the photoconductive drum 1, any one of the color developing apparatuses 3 can be moved to a position at which it can be placed in contact with, or moved away from, the peripheral surface of the photoconductive drum 1, or so that it can be kept in a position at which it does not contact the photoconductive drum 1. The black developing apparatus 4 is also a two-component type developing apparatus containing black toner. It is stationarily disposed next to the photoconductive drum 1, and is placed in contact with the photoconductive drum 1 by an unshown developing apparatus moving means only during a development process.

The toner image formed on the photoconductive drum 1 is transferred onto a transfer medium p as a recording medium, while the transfer medium p is conveyed in the direction indicated by an arrow mark a, being borne on a transfer drum 5 as a transferring apparatus.

The toner particles remaining on the photoconductive drum 1 after the image transfer are removed by a drum cleaning apparatus 7 disposed on the downstream side with respect to the transfer drum 5 in terms of the rotational direction of the photoconductive drum 1. The removed toner particles are discharged as waste toner particles from the cleaning apparatus 7, and are conveyed through a waste toner discharge path, in which an unshown conveying screw is disposed, to the developer recovery portion in the main assembly of the image forming apparatus, where they are collected.

The transfer drum 5 comprises: a drum as a base member; a transfer sheet 8 pasted to the peripheral surface of the base member; and a transfer medium attracting means for keeping a transfer medium P adhered to the transfer sheet 8, as the transfer medium p is delivered to the transfer drum 5. The transfer medium attracting means has an attraction charger 9, and an electrically conductive roller 10. The attraction charger 9 is for giving the back side (surface facing inward of transfer drum 5) of the transfer medium p electric charge opposite in polarity to the toner image on the photoconductive drum 1.

The conductive roller 10 is disposed outside the transfer drum 5. Not only does it function as the opposing electrode for the attraction charger 9, but also it injects electric charge into a transfer medium p to keep the transfer medium p electrostatically adhered to the transfer sheet 8.

Also within the transfer drum 5, a transfer charger 11 and an AC corona discharger 12 are disposed. The transfer charger I 1 is for giving the transfer sheet 8 electric charge opposite in polarity to the toner, and is disposed in contact with the internal surface of the transfer drum 5, on the position corresponding to the position of the interface between the photoconductive drum I and transfer drum 5. Outside the transfer drum 5, an AC corona discharger 13 is provided, which opposes the AC corona discharger 12, with the presence of the transfer sheet 8 between the two, and is for reducing the attraction between the transfer medium p and transfer sheet 8 after the toner image transfer. On the downstream side in terms of the rotational direction of the transfer drum 5 with respect to the AC corona chargers 12 and 13, a separation claw 14 is provided. Further, an AC corona discharger 15 is disposed next to the AC corona discharger 13, that is, the discharger on the outward side.

The AC corona discharger 15 is for discharging AC corona in order to prevent an unfixed toner image from being disturbed by the separation discharge which occurs as the, transfer medium p is separated from the transfer sheet 8.

A plurality of transfer mediums p are stored in a cassette 16, and are fed one by one into the image forming apparatus main assembly by a pickup roller 17, from the top. Then, each transfer medium p is released by a registration roller pair 18 so that it reaches the transfer drum 5 in synchronism with the arrival of the toner image on the photoconductive drum 1 at the transfer drum 5. Then, the transfer medium p is conveyed between the conductive roller 10 and attraction charger 9 by the rotation of the transfer drum S. While the transfer medium p is conveyed between the conductive roller 10 and attraction charger 9, the transfer medium p is kept electrostatically adhered to the transfer sheet 8, that is, the surface portion of the transfer drum 5, and is conveyed through the transfer station, that is, the contact area between the photoconductive drum 1 and transfer drum 5. While the transfer medium p is conveyed through the transfer station, the toner image on the photoconductive drum r is transferred onto the transfer medium p by the transfer charger 11.

The above described image formation process, in which a toner image is formed on the photoconductive drum 1 and is transferred onto a transfer medium p, is repeated four times, that is, once for each of the four color components, that is, yellow, magenta, cyan, and black components, with the transfer medium p remaining borne on the transfer drum 5. Then, the attraction between the transfer medium p medium p is conveyed between the AC corona dischargers 12 and 13. Next, the transfer medium p is separated from the transfer sheet 8 by the separation claw 14. Thereafter, the transfer medium p is conveyed in the downward direction by a conveyer belt 19 to a fixing apparatus, and conveyed between the fixing roller 20 and pressure roller 21 of the fixing apparatus. While it is conveyed through the two rollers 20 and 21, the unfixed toner image on the transfer medium p is thermally fixed to the transfer medium p.

When the image forming apparatus is in the single-side image formation mode, the transfer medium p is immediately discharged by a discharge roller pair 22 into a delivery tray 23 located outside the image forming apparatus, whereas when the image forming apparatus is in the two-sided image formation mode, the transfer medium p is flipped over after the fixation of the unfixed toner image on a first of the two surfaces of the transfer medium p, and then, is conveyed again to the transfer drum 5, with the other surface facing the photoconductive drum 1.

Then, another toner image is transferred onto the other surface, or the second surface, of the recording medium p, and is fixed. Thereafter, the transfer medium p is discharged into the delivery tray 23.

Next, the color developing apparatuses 3 (3M–3Y) in this embodiment will be described. The three color developing apparatuses 3M–3Y are identical in structure. Therefore, the magenta developing apparatus 3M shown in FIG. 2 will be described as an example. The developing apparatus 3M is mounted, along with the two other developing apparatuses 3C and 3Y, in the development rotary 3A, with the three developing apparatuses being evenly distanced from the adjacent ones.

The magenta developing apparatus 3M contains magenta developer 32, which is two-component developer (mixture of toner and carrier). As the magenta developer 32 in the magenta developing apparatus 3M is stirred by conveyer screws 33*a* and 33*b*, the developer is conveyed to the development sleeve 30, as a developer bearing member, while being given triboelectrical charge. Then, the magenta developer is picked up onto the peripheral surface of the development sleeve 30 by the magnetic pole N3 of the magnet 31 disposed within the development sleeve 30. Then, the magenta developer 31 on the peripheral surface of the development sleeve 30 is conveyed by the magnetic poles S2 and N1 and the rotation of the development sleeve 30, to the development station, that is, the interface between the peripheral surfaces of the development sleeve 30 and photoconductive drum I—The position of the development station corresponds to that of the magnetic pole S1, that is, the primary development pole, of the magnet 31. In the development station, the magenta developer on the peripheral surface of the development sleeve 30 is used for developing the electrostatic latent image on th photoconductive drum 1. Also in the development station, the combination of AC and DC biases is applied between the development sleeve 30 and photoconductive drum I by a bias applying means 37, in order to facilitate the development process.

The carrier particles for the two-component developer 32 are desired to be magnetic particles, which are 30–100 $\mu$m preferably, 40–80 $\mu$m, in particle diameter, and no less than $10^7$ Ωcm, preferably, no less than $10^8$ Ωcm, more preferably, in the range of $10^9$–$10^{14}$ Ωcm, in electrical resistance value (volume resistivity). Such ferrite particles (maximum magnetization: 60 $Am^2/kg$) that have been coated with resinous material to adjust their electrical resistance to the above described value, are preferable carrier for the two-component developer 32.

In this embodiment, the electrical resistance value of the above described magnetic particles (for example, resin coated ferrite particles) was obtained by the following method: The magnetic particles are packed in a sandwich type cell, which was 4 $cm^2$ in the size of the measurement electrode, and 0.4 cm in the gap between the measurement electrodes, and the resistance value of the magnetic particles was obtained from the electric current which flowed through the circuit when a voltage E (V/cm) was applied between the two electrodes while placing a load of 1 kg on one of the electrodes.

The two-component developer is desired to be in the range of 6–9 $\mu$m in average particle diameter, in this embodiment of the present Invention, those which were 7.5 in average particle diameter were used.

After the development, the developer particles 32 on the development sleeve 30 are returned by the rotation of the development sleeve 30 to the developing apparatus 3M, in which they are moved away from the development sleeve 30 by the repulsive magnetic field between the magnetic poles N2 and N3 of the magnet 31, are mixed with the developer within the developing apparatus 3M as they are stirred by the screws 33*a* and 33*b*, and are picked up again onto the development sleeve 30. It is thought that the repetition of this stirring operation prevents the problem that the efficiency, with which the magnetic carrier particles give triboelectrical charge to the toner particle, is reduced by the adhesion of the toner particles and external additive to the surfaces of the magnetic carrier particles.

Next, the supply and recovery of the color developers in this embodiment will be described. However, they are the same as those disclosed In Japanese Laid-open patent Application 9-218575.

Therefore, they will be described only briefly here.

The replenishment of the developing apparatus 3M with the developer 32, and the recovery of the developer 32 from the developing apparatus 3M, are accomplished together by the replenishment developer cartridge 34 mounted in the development rotary 3A. In other words, the supply and recovery of the developer 32 are accomplished by the replacement of the replenishment develop cartridges 34, eliminating the annoyance, which users experience if the developing apparatuses must be removed from the image forming apparatus in order to switch the developer, and also, eliminating the maintenance related to the developer replacement.

The cartridge 34 has internal spaces 34*a* and 34*b* completely separated by a partitioning wall 38. The space 34*a* occupies approximately 80% of the internal space of the cartridge 34, and constitutes the replenishment developer storage, whereas the other space 34*b* occupies approximately 20% of the internal space of the cartridge 34, and constitutes the space in which the recovered developer (mixture of toner and carrier), as waste developer, is stored. The replenishment developer is almost pure toner, containing carrier at a predetermined ratio (minute).

Although in this embodiment, the surplus developer (mixture of toner and carrier) delivered to development station from the developing apparatus (for example, 3M) is called "waste developer", it does not mean such developer that became unusable. It is ideal that the developing apparatus is designed so that carrier will be the only ingredient of "waste developer." In reality, however toner is also excessively delivered to the development station, along with the excessive amount of carrier particles. Thus, if this ideal structure is realized, the "waste developer" means such waste developer that is pure carrier.

First, the replenishment of the developing apparatus with color developer will be described. Within the replenishment developer space 34*a* of the replenishment developer cartridge 34, an unshown stirring/conveying member is disposed, which slowly rotates, conveying the replenishment developer to an unshown opening located in the bottom portion of the cartridge 34, during a development process. In the bottom portion of the cartridge 34, a replenishment developer delivery screw 36 is disposed, which is covered with a casing 39. The casing 39 is provided two openings. One is located in the most upstream portion in terms of the direction in which the replenishment developer is conveyed by the screw 36, and is connected to the opening of the cartridge 34, whereas the other is located in the most downstream portion, and is connected to the opening of the top portion of the developing apparatus 3M.

After being conveyed to the opening of the bottom portion of the cartridge 34, the replenishment developer is taken over by the replenishment developer delivery screw 36, and is supplied by the screw 36 to the developing apparatus 3M, compensating for the toner consumed for image formation from the developing apparatus.

The replenishment developer is virtually pure toner, containing only a minute amount of carrier; the amount of toner in the replenishment developer is overwhelmingly larger than that in the two-component developer in the developing apparatus 3M. Thus, as the developing apparatus 3 is compensated for the toner consumed for image formation, it is also replenished with a minute amount of carrier.

Increasing the ratio of the carrier in the replenishment developer increases the amount of the carrier supplied to the developing apparatus 3M per unit of the toner supplied to the developing apparatus, restoring therefore the developer in the developing apparatus 3M closer to the initial state, which increases, as such carrier consumption. Therefore, the mixing ratio between the toner and carrier should be determined according to the characteristics of each image forming apparatus. In this embodiment, the mixing ratio between the toner and carrier was set to approximately 9:1. However, the ratio does not need to be limited to this value.

The amount by which toner (hence, carrier) is supplied is approximately controlled by the revolution of the replenishment developer delivery screw 36, and the revolution of the screw 36 is determined by an unshown toner supply controlling means. There are various methods usable for controlling the amount by which toner is supplied. For example, there are methods in which the amount is controlled based on the toner content of the two-component developer optically or magnetically detected, methods in which the amount is controlled based on the toner image density obtained by developing a referential electrostatic latent image formed on the photoconductive drum 1, etc. The selection is optional.

In the bottom portion of the cartridge 34, a recovery nozzle 35 is disposed. The top end of the recovery nozzle 35 is connected to the recovered developer space 34*b*, and the bottom end is extended into the developing apparatus 3M, being open in the top portion of the developing apparatus 3M. As the replenishment toner containing a minute amount of carrier is supplied, the level of the two-component developer 32 in the developing apparatus 3M rises past the bottom end 35A of the recovery nozzle 35. If the development rotary is rotated in this state in the direction indicated by an arrow mark C, the developer 32 is recovered into the recovered developer space 34*b* through the opening of the bottom end 35A of the nozzle 35 and the nozzle 35.

In this case, there is a possibility that the developer 32 will overflow from the developing apparatus 3M when the developing apparatus 3M is replenished with developer next time. However, such a problem can be prevented by structuring the developing apparatus 3M so that the rate of the developer recovery through the recovery nozzle 35 becomes greater than the maximum rate of the delivery of the replenishment developer from the cartridge 34, and also, so that the rotary 3A is always rotated after a latent image corresponding to the magenta component is developed.

Next, referring to FIG. 3, the black developing apparatus in this embodiment will be described. The developing apparatus 4 contains two-component developer containing black toner. As the developer in the developing apparatus 4 is stirred by conveyer screws 43*a* and 43*b*, the developer is conveyed to the development sleeve 40 while being given triboelectrical charge. Then, the developer is picked up onto the peripheral surface of the development sleeve 40 by the magnetic pole N3 of the magnet 41 disposed within the development sleeve 40. Then, the developer on the peripheral surface of the development sleeve 40 is conveyed by the magnetic pole S2 and rotation of the development sleeve 40 to the development station, that is, the interface between the peripheral surfaces of the development sleeve 40 and photoconductive drum 1. The position of the development station corresponds to that of the magnetic pole Nl, that is, the primary development pole, of the magnet 41. In the development station, the developer on the peripheral surface of the development sleeve 40 is used for developing the electrostatic latent image on the photoconductive drum 1. Also in the development station, the combination of AC and DC biases is applied between the development sleeve 40 and photoconductive drum 1 by a bias applying means 44, in order to facilitate the development process.

The carrier particles of the two-component developer 42 are the same as those of the above described color developer 32, and are desired to be magnetic particles. In terms of average particle diameter, the toner particles of the developer 42 are similar to those in the color developer 32. In other words, they are desired to be in the range of 6–9 $\mu$m in average particle diameter. In this embodiment, such carrier that is 7.5 $\mu$m in average particle diameter was used.

After the development, the developer particles 42 on the development sleeve 40 are returned by the rotation of the development sleeve 40 to the developing apparatus 4, in which they are moved past area corresponding to the position of the magnetic pole (conveyance pole) SI of the magnet 41, are moved away from the development sleeve 40 by the repulsive magnetic field between the magnetic poles N2 and N3 of the magnet 41, are mixed with the developer within the developing apparatus 4 as they are stirred by the screws 43*a* and 43*b*, and are picked up again onto the development sleeve 40. It is thought that the repetition of this stirring operation prevents the problem that the efficiency, with which the magnetic carrier particles give triboelectrical charge to the toner particle, is reduced by the adhesion of the toner particles and external additive to the surfaces of the magnetic carrier particles.

Next, the replenishment of the black developing apparatus 4 with black developer, and the recovery of the black developer, will be described.

Referring to FIG. 3, the black developing apparatus 4 is provided with a developer recovery portion 45, which is located outside the lateral wall of the developing apparatus, on the conveyance screw 43*b* side.

The developer recovery portion 45 has an opening 45A, through which the portion 45 is connected to the top portion of the developing apparatus 4, allowing the developer to move between the developing apparatus 4 and developer recovery portion 45. The pitch of the screw 43*b* is made smaller in the adjacencies of the opening 45A, allowing the developer to stagnate in the adjacencies of the opening 45A.

The top portion of the developing apparatus 4 is fitted with a replenishment developer hopper 48 equipped with a developer delivery screw 47. In this embodiment, the replenishment developer hopper 48 is filled with such toner that contains carrier at a certain ratio (approximately 10% in weight). The developing apparatus 4 is stationarily disposed. Therefore, the hopper 48 can be made greater in capacity than any of the cartridges 34 of the color developing apparatuses 3 (3M–3C), holding a larger amount of black replenishment developer therein.

As the toner of the developer 42 in the developing apparatus 4 is consumed for image formation, toner is supplied, as a part of the replenishment developer containing carrier at a certain ratio, to the developing apparatus 4, from above, that is, from the hopper 48, by the developer delivery screw 47, in a manner to keep constant at a predetermined level, the toner content of the two-component developer 42 in the developing apparatus. As the replenishment developer is supplied to the developing apparatus 4, the level of the developer 42 in the developing apparatus 4 rises in area next to the opening 45A, where the developer stagnates. As a result, the developer particles in the above described developer stagnation area overflow into the recovery portion 45 through the opening 45A, and collect in the recovery portion 45.

Also referring to FIG. 3, within the developer recovery portion 45, a conveyer screw 46 is disposed. After having collected in the recovery portion 45, the recovered developer is moved by the screw 46 to the rear side of the developing apparatus 4 (rearward of FIG. 3), where a developer discharge passage is located. The developer discharge passage is the passage through which the waste toner recovered by the cleaning apparatus 7 in FIG. 1 is conveyed, and in which an unshown conveyer screw for conveying the waste toner is disposed. Thus, the recovered developer joins with the waste toner in the developer discharge passage, and is discharged from the image forming portion by the unshown conveyer screw in the developer discharge passage, while being mixed with the waste toner by the screw.

Thereafter, the mixture is conveyed to the recovery portion of the image forming apparatus main assembly.

Through the above described process, the two-component developer 42 within the black developing apparatus 4 is gradually replaced.

Also as described above, in this embodiment, the color developing apparatuses are structured so that they can be used in combination with a replaceable replenishment developer cartridge. Therefore, when a single or plurality of color developing apparatus run out of the developer while the image forming apparatus outputs a full-color image, the color developing apparatuses depleted of developer do not need to be removed from the image forming apparatus in order to directly replenish the empty developing apparatuses with developer. Instead, only the employ replenishment developer cartridges have to be replaced. Therefore, the image forming apparatus can be more efficiently and reliably operated.

As for the black developing apparatus, it is stationarily disposed relative to the photoconductive drum 1. More specifically, it is not orbitally moved as are the color image developing apparatuses, and is not structure so that it is used with a replaceable replenishment developer cartridge. Instead, it is provided with the recovery Portion connected to the top portion of the black developing apparatus, and the pitch of the conveyer screw in the black developing apparatus is made smaller across one of the end portions thereof, so that as the developer is circulated in the developing apparatus, a part of the developer is allowed to stagnate in the adjacencies of the end portion of the conveyer screw with the reduce pitch, and so that the developer is recovered from this developer stagnation area into the recovery portion.

In other words, the developer can be automatically and gradually replaced with the employment of a simple structure. Further, the recovered developer is discharged with the use of the recovery screw for conveying the waste toner from the drum cleaning apparatus, simplifying the discharging process which comes after the recovery.

Thus, unlike a black developing apparatus in accordance with the prior art, the black developing apparatus in this embodiment does not need to be orbitally moved to discharge the developer, even if black images are consecutively outputted. In other words, when the color image forming apparatus in this embodiment is in the black-and-white mode, it does not require the time consuming orbital movement of the black developing apparatus, eliminating the weaknesses of a color image forming apparatus in accordance with the prior art, that is, the weakness that when it is in the black-and-white mode, it is inferior in productivity to an image forming apparatus dedicated for the formation of black-and-white images, in spite of its superiority in terms of maintenance.

To sum it up, according to this embodiment, it was possible to realize a color image forming apparatus which is easy to maintain, and yet, the productivity of which in the black-and-white mode is just as high as that of an image forming apparatus dedicated for the formation of black-and-white images.

Embodiment 2

Figure 4:
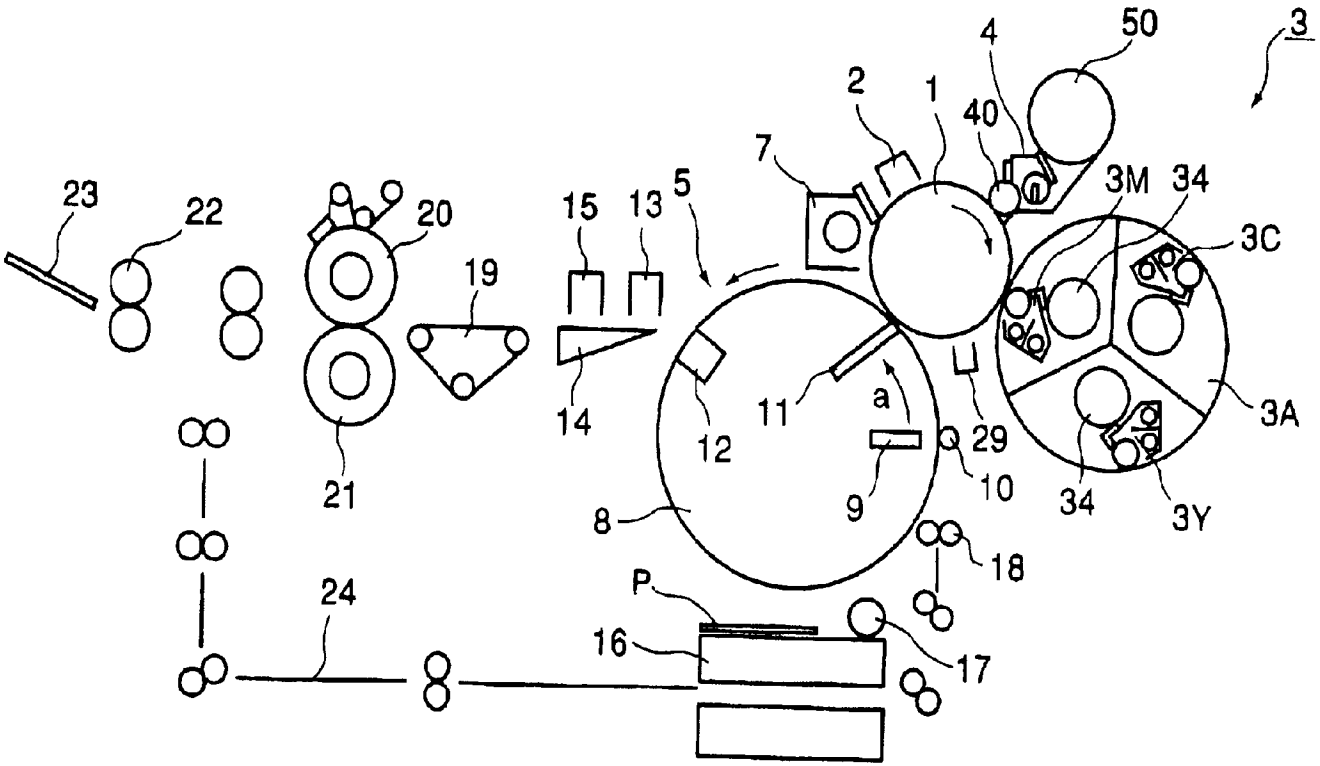
FIG. 4 is a schematic drawing of another example of an image forming apparatus in accordance with the present invention.

FIG. 4 is a schematic drawing of another embodiment of the present invention.

This embodiment is characterized in that a developing apparatus employing one of the jumping developing methods is employed as the black developing apparatus 4. The component, member, etc., designated in FIG. 4 by the same referential codes as the referential codes in FIG. 1 are identical to those in FIG. 1;

The jumping developing method in this embodiment is a noncontact developing method which uses magnetic single-component developer (magnetic toner). If the carrier of the developer in any of the color developing apparatuses 3 (3M–3C) mixes into the black developing apparatus of the jumping type, defective images are formed.

Therefore, the black developing apparatus is desired to be disposed on the upstream side with respect to the color developing apparatuses in terms of the rotational direction of the photoconductive drum 1, for the following reason: With the black developing apparatus disposed on the upstream side with respect to the color developing apparatuses, even if the carrier from any of the color developing apparatuses transfers onto the photoconductive member, it is recovered by the cleaning apparatus 7 before it reaches the black developing apparatus 4. Therefore, the phenomenon that images with a low density are formed due to the mixture of the carrier from the color developing apparatuses into the black developing apparatus is prevented.

The black developing apparatus 4 may be attached to a movable platform or the like of an apparatus mount solidly fixed to the apparatus main assembly, so that it can be placed virtually in contact with the photoconductive drum 1 during a development process and moved away from the photoconductive drum 1 thereafter. It is also possible to stop the development sleeve 40 after the end of the development, and expel the toner particles on the portion of the peripheral surface of the development sleeve 40 opposing the photoconductive drum 1, by applying such bias that aggressively expels the toner particles on the development sleeve 40. With the provision of such an arrangement, it is unnecessary to repeatedly mounting or dismounting the black developing apparatus 4.

The overall image forming operation of the image forming apparatus in this embodiment is virtually the same as that in the first embodiment. Therefore, it will not be described here, and only the Jumping developing method using magnetic single-component developer will be described.

When a black image is formed by the image forming apparatus in this embodiment, an electrostatic latent image formed on the photoconductive drum I is reversely developed info a toner Image, that is, a visible image, by the developing apparatus 4 which uses the jumping developing method. In this embodiment, negative black toner the particle diameter of which was 8 $\mu$m, was used as the toner for the magnetic single-component developer. The developing apparatus 4 is fitted with a toner cartridge 50, from which magnetic toner is supplied to the developing apparatus 4.

The development bias applied to the development sleeve 40 was the combination of an AC voltage which is 2,200 Hz in frequency, 1,400 Vpp in amplitude, 50% in duty ratio, and rectangular in waveform, and a DC voltage of −500. The S-B gap, that is, the gap between the development sleeve and developer regulating blade was set to 250 $\mu$m, and the S-D gap, that is, the gap between the development sleeve and photoconductive drum was set to also 250 $\mu$m.

Black toner is smaller in the amount of triboelectric charge than color toner, such as yellow, magenta and cyan toner particles, etc. Therefore, a post-charger 29 is disposed on the upstream side, with respect to the transfer station, in terms of the rotational direction of the photoconductive drum 1 so that the black toner image on the photoconductive drum I is transferred onto a transfer medium p after the toner particles in the black toner image are charged by the post-charger 29.

As is evident from the above description, also in this embodiment as in the first embodiment, the color developing apparatuses does not need to be removed from the image forming apparatus to directly replace the developer, when consecutively outputting a large number of full-color images; in other words, all that is necessary is to replace the replenishment developer cartridges, making it possible to reliably form a large number of full color images. Further, in this embodiment, a developing apparatus employing a single-component jumping developing method, which does not require the replacement of the developer, is used as the black developing apparatus. Therefore, even when consecutively outputting a large number of black-and-white images, the black developing apparatus does not need to be rotated to discharge the developer; in other words, the rotation of the black developing apparatus, which reduces the productivity of the image forming apparatus, is unnecessary, eliminating the problem of a color Image forming apparatus in accordance with the prior art, that is, the problem that when in the black-and-white mode, its productivity is lower than that of an image forming apparatus dedicated for the formation of black-and-white images.

In the foregoing portion of this specification, the present invention regarding an image forming apparatus was described with reference to two embodiments of the present invention. However, this does not mean that the application of the present invention should be limited to these embodiments; the present invention can be easily embodied in various forms by any person in the same line of business as those of the inventors of the present invention.

As described above according to the preceding embodiments of the present invention, it is possible to provide a color image forming apparatus, the developing apparatuses of which are superior from the standpoint of maintenance, the productivity of which in the black-and-white mode is just as high as that of an image forming apparatus dedicated for the formation of black-and-white images, and which is simple in structure and low in cost. In addition, even when the black developing apparatus is structured as a developing apparatus which uses magnetic single-component developer which does not require recovery, the effects similar to those described above can be obtained.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

a plurality of first developing devices, for developing an electrostatic latent image formed on said image bearing member at a first developing position using a developer comprising a toner and a carrier;

a rotatable member rotatable in a path including the first developing position, for supporting said plurality of first developing devices, wherein each of said plurality of first developing devices is effective to discharge excess developer produced by receiving the developer including the toner and the carrier to outside of each of said plurality of said first developer devices using a rotation of said rotatable member; and a second developing device for developing an electrostatic latent image formed on said image bearing member at a second developing position using a developer comprising a toner, wherein said second developing device is disposed so as to be non-rotatably adjacent to said image bearing member.

2. An apparatus according to claim 1, wherein each of said plurality of first developing devices contains chromatic toner particles having colors different from each other, and wherein said second developing device contains black toner particles.

3. An apparatus according to claim 1 or 2, wherein said apparatus is operable in a first mode in which a multi-color image is formed using said plurality of first developing devices and said second developing device, and in a second mode in which a mono-color image is formed using only said second developing device.

4. An apparatus according to claim 1, further comprising a collecting portion for collecting the excess developer, which is discharged from said plurality of first developing devices, and a plurality of developer replenishing containers, corresponding to respective ones of said plurality of first developing devices, for supplying the developers including the toner particles and the carrier to said plurality of first developing devices, wherein the excessive developers are collected using the rotation of said rotatable member.

5. An apparatus according to claim 1, wherein said second developing device contains a one-component developer including a magnetic toner.

6. An apparatus according to claim 5, wherein said second developing device is disposed such that the second developing position is upstream of and adjacent to the first developing position with respect to a peripheral movement direction of said image bearing member.

7. An apparatus according to claim 1, wherein said second developing device contains a two-component developer including the toner and a carrier, wherein the excessive developer in said second developing device produced by replenishment of the developer is discharged to outside of said second developing device without using the rotation of said rotatable member.

8. An apparatus according to claim 7, wherein said second developing device is provided with an opening for permitting discharge of the excess developer resulting from the replenishment for the two-component developer.

9. An apparatus according to claim 1, further comprising:

a plurality of developer replenishing containers for replenishing the developer in each of said plurality of first developing devices, respectively, and a second developer replenishing container for replenishing the developer in said second developing device, wherein said second developer replenishing container has a capacity larger than a capacity of said plurality of first developer replenishing containers.

* * * * *

UNITED STATES PATENT AND TRADEMARK OFFICE

CERTIFICATE OF CORRECTION

PATENT NO. : 6,850,722 B2
DATED : February 1, 2005
INVENTOR(S) : Yuji Sakemi et al.

It is certified that error appears in the above-identified patent and that said Letters Patent is hereby corrected as shown below:

Title page,
Item [56], References Cited, FOREIGN PATENT DOCUMENTS, please insert:
-- CHINA 94101060.1 1/2001--.

Column 1,
Line 25, "period" should read -- period of --;
Line 39, "an" should read -- a --;
Line 56, "Image" should read -- image --; and
Line 57, "to," should read -- to --.

Column 2,
Line 4, "(U.S.A. patent Journal No." should read -- U.S. Patent No. --;
Line 33, "or" should read -- of --;
Line 39, "of" should read -- of the --;
Line 40, "concerns." should read -- concerns: --; and
Line 52, "developed:" should read -- developed; --.

Column 3,
Line 2, "image" should read -- images --;
Line 25, "Image" should read -- image --;
Line 27, "is" should be deleted; and
Line 64, "1—This" should read -- 1. This --.

Column 4,
Line 58, "medium P" should read -- medium p --;
Line 65, close up right margin; and
Line 66, close up left margin.

Column 5,
Line 6, "charger I1" should read -- charger 11 --;
Line 10, "drum I" should read -- drum 1 --;
Line 23, "as the," should read -- as the --;
Line 41, "drum r" should read -- drum 1 --; and
Line 49, "medium p" should read -- medium p and transfer sheet 8 is reduced while the transfer --.

Column 6,
Line 31, "drum I—The" should read -- drum 1. The --;
Line 36, "th" should read -- the --;
Line 39, "drum I" should read -- drum 1 --;

UNITED STATES PATENT AND TRADEMARK OFFICE

CERTIFICATE OF CORRECTION

PATENT NO. : 6,850,722 B2
DATED : February 1, 2005
INVENTOR(S) : Yuji Sakemi et al.

It is certified that error appears in the above-identified patent and that said Letters Patent is hereby corrected as shown below:

Column 6 (cont'd),
Line 47, "$10^9$-10$^{14}$" should read -- $10^9$-$10^{14}$ --;
Line 65, "diameter, in" should read -- diameter. In --; and
Line 66, "Invention," should read -- invention, --.

Column 7,
Line 26, "develop" should read -- developer --; and
Line 48, "however" should read -- however, --.

Column 8,
Line 21, "such" should read -- such, --; and
Line 51, "the nozzle 35 and the nozzle 35." should read -- nozzle 35. --.

Column 9,
Line 10, "pole N1" should read -- pole Nl, --; and
Line 31, "SI should read -- S1 --.

Column 10,
Line 52, "structure" should read -- structured --; and
Line 54, "Portion" should read -- portion --.

Column 11,
Line 31, "FIG. l;" should read -- FIG. 1 --; and
Line 64, "to" should read -- to be --.

Column 12,
Line 2, "Jumping" should read -- jumping --;
Line 6, "drum I" should read -- drum 1 --;
Line 27, "drum 1" should read -- drum 1, --;
Line 28, "drum I" should read -- drum 1 --; and

UNITED STATES PATENT AND TRADEMARK OFFICE

CERTIFICATE OF CORRECTION

PATENT NO. : 6,850,722 B2
DATED : February 1, 2005
INVENTOR(S) : Yuji Sakemi et al.

It is certified that error appears in the above-identified patent and that said Letters Patent is hereby corrected as shown below:

Column 12 (cont'd),
Line 48, "Image" should read -- image --.

Signed and Sealed this

Fifth Day of July, 2005

JON W. DUDAS
*Director of the United States Patent and Trademark Office*